US012043930B1

(12) United States Patent
Lin

(10) Patent No.: US 12,043,930 B1
(45) Date of Patent: Jul. 23, 2024

(54) WOOL KNITTING MACHINE

(71) Applicant: Shantou Lemai Culture Co., Ltd., Shantou (CN)

(72) Inventor: Xiaorong Lin, Shantou (CN)

( * ) Notice: Subject to any disclaimer, the term of this patent is extended or adjusted under 35 U.S.C. 154(b) by 0 days.

(21) Appl. No.: 18/220,860

(22) Filed: Jul. 12, 2023

(51) Int. Cl.

| | |
|---|---|
| ***D04B 15/60*** | (2006.01) |
| ***A63H 33/30*** | (2006.01) |
| ***D04B 9/06*** | (2006.01) |
| ***D04B 9/22*** | (2006.01) |
| ***D04B 15/32*** | (2006.01) |
| ***D04B 15/78*** | (2006.01) |
| ***D04B 15/94*** | (2006.01) |

(52) U.S. Cl.
CPC ..... *D04B 15/60* (2013.01); *D04B 9/06* (2013.01); *D04B 9/22* (2013.01); *D04B 15/32* (2013.01); *D04B 15/78* (2013.01); *D04B 15/94* (2013.01); *A63H 33/3088* (2013.01); *D10B 2211/02* (2013.01)

(58) Field of Classification Search
CPC ..... A63H 33/3088
USPC ..... 66/1 R, 1 A, 60 H
See application file for complete search history.

(56) References Cited

U.S. PATENT DOCUMENTS

| | | | | | |
|---|---|---|---|---|---|
| 128,421 | A * | 6/1872 | Pease | D04B 9/06 | 66/115 |
| 2,108,705 | A * | 2/1938 | Broadwin | D04B 9/44 | 66/57 |
| 5,050,405 | A * | 9/1991 | Jacobsson | D04B 9/02 | 242/366.4 |
| 6,276,986 | B1 * | 8/2001 | Wu | A63H 33/3088 | 446/474 |
| D946,059 | S * | 3/2022 | Zhang | D15/66 | |
| D946,634 | S * | 3/2022 | Zhang | D15/66 | |
| 2018/0209078 | A1 * | 7/2018 | Novak | D04B 3/00 | |

FOREIGN PATENT DOCUMENTS

| | | | | |
|---|---|---|---|---|
| CN | 2748139 Y | * | 12/2005 | A63H 33/30 |
| CN | 210229152 U | * | 4/2020 | A63H 33/30 |
| GB | 2284432 A | * | 6/1995 | D04B 9/44 |

OTHER PUBLICATIONS

Snow Key chain. "Knitting Machine,22 Needles Smart Knitting Board Rotating Double Knit Loom Machine,Knitting Loom Machine with Row Counter for Kids Children Adults Beginners." Retrieved from internet: https://www.amazon.com/Knitting-Machine-Rotating-Children-Beginners/dp/B08NYVR9CG?th=1 (Year: 2020).*

* cited by examiner

*Primary Examiner* — Aiying Zhao
(74) *Attorney, Agent, or Firm* — Hawaii Patent Services; Nathaniel K. Fedde; Kenton N. Fedde

(57) ABSTRACT

A wool knitting machine comprising a shell, a knitting device, a yarn feeding device and a clamping device. When each crochet needle reaches the position of a yarn inlet of a yarn feeding port, the clamping device is clamped with the current crochet needle for clamping the wool, and at the same time, an accelerating gear device is arranged in a hand crank to increase the speed of hand knitting, so that a user can make the first knitting circle compact enough without manually tensioning the wool.

20 Claims, 9 Drawing Sheets

WOOL KNITTING MACHINE

TECHNICAL FIELD

The present invention relates to the technical field of knitting machines, in particular to a novel wool knitting machine.

BACKGROUND

Hand knitting machine can knit a mass of wool into gloves, hats and other fabrics in a short time. At the same time, it is small in size and simple to operate, and it is more and more loved and used by the majority of manual enthusiasts. Many parents also use it as a children's toy to cultivate children's hobbies.

However, there are some design defects in the hand-operated knitting machine in the prior art, which leads to inconvenient knitting process and unsatisfactory fabric forming effect. For example, China patent NO. 201198520 discloses a toy knitting machine, which comprises a bracket, a wheel shell, a wheel core, a plurality of crochet needles and a crank, wherein the wheel shell is fixed on the bracket, the wheel core is sleeved in the wheel shell, gears on the crank are meshed with racks on the wheel core, and the upper ends of the wheel core are distributed at intervals. There is a needle groove between a pair of hanging needles, and each crochet needle is movably placed in the gap between the wheel core and the wheel shell. A hook is formed at the upper end of the crochet needle, and a guide column is formed at the lower end of the crochet needle. The guide column is movably inserted into the curved groove of the wheel shell. During the rotation of the wheel core, the crochet needle rotates with the wheel core, and the crochet needle is limited by the curved groove to fluctuate up and down in turn during the rotation, so as to repeatedly crochet wool through the alternating fluctuation of the crochet needle.

Although the toy knitting machine used in this scheme can knit gloves or hats quickly, its knitting process is limited by functional and design defects. During the first knitting operation, the user needs to hold the wool manually until the first knitting operation is finished. This is because the wool cannot be effectively fixed by crochet when it enters the knitting structure, resulting in the fabric structure is not compact and loose in the first lap, and the wool needs to be tightened manually. Only in this way can the first knitting circle be tight enough, which is extremely inconvenient in the practical process. In addition, the toy knitting machine of this scheme needs to continuously rotate the handle for many times to complete a knitting operation, which will consume a lot of physical strength and make the user's arm ache in the practical use process.

Based on the above problems, it is necessary to put forward a novel wool knitting machine, which can make the first knitting operation of fabric compact enough without relying on the user to hold the wool manually, and at the same time, it can quickly complete the knitting operation without consuming a lot of physical strength when it is driven by hand.

SUMMARY

The present invention provides a novel wool knitting machine, which includes a shell a knitting device, a yarn feeding device and a clamping device; wherein a middle part of the shell is provided with a hollow annular groove for installing the knitting device; the knitting device comprises a crochet needle cylinder rotatably arranged in the annular groove, a plurality of crochet needles distributed annularly, a wool separating ring installed at an upper part of the crochet needles, and a driving mechanism installed at one side of the shell; the driving mechanism drives the crochet needle cylinder to rotate, so as to make the crochet needles do knitting movement up and down;

the yarn feeding device comprises a yarn feeding port arranged at one side of the shell, wherein the yarn feeding port defines a yarn feeding channel for the wool to enter the knitting device, and further comprises a yarn rack installed at a lower end of the yarn feeding port; the yarn rack is provided with at least one threading hole and a section groove communicated with the threading hole; the clamping device is arranged beside the yarn feeding port and comprises an sensing module and a clamping module, wherein when the sensing module senses that the crochet needle reaches the yarn feeding port, the sensing module controls the clamping module to clamp the crochet needle to clamp the wool.

The present invention provides a novel wool knitting machine. The driving mechanism consists of an annular gear ring installed on the side edge of a crochet needle cylinder and a hand crank for driving the annular gear ring to rotate. The inner end of the hand crank is provided with a transmission gear meshing with the annular gear ring, and an accelerating gear set is also arranged in the hand crank, so that the speed of hand knitting is increased by using the accelerating gear set.

BRIEF DESCRIPTION OF DRAWINGS

The accompanying drawings illustrate exemplary embodiments of the disclosure and together with the description serve to explain the principles of the disclosure. The accompanying drawings are included to provide a further understanding of the disclosure and are included in and constitute a part of this specification.

In the figures.

Figure 1:
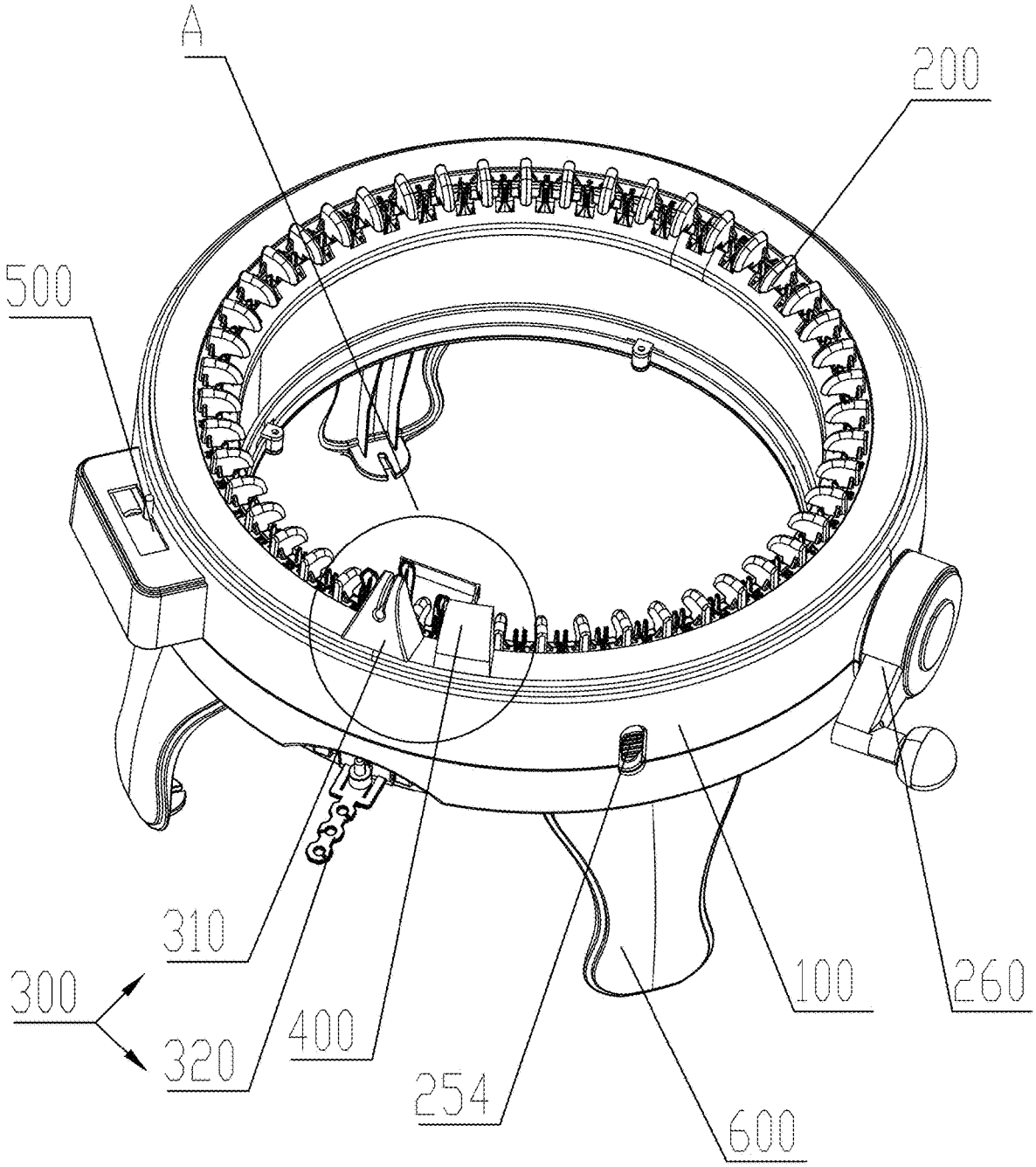
FIG. 1 is a schematic perspective view of the present invention.

100, Shell; 110, Annular groove; 120, Face cover; 130, Bottom cover; 140, Inner ring cover; 141, Convex surface; 150, Needle cylinder base; 151, Side cover groove; 152, Convex position; 160, Guide block; 161, Notch groove; 200, Knitting device; 210, Crochet needle cylinder; 220, Crochet needle; 230, Wool separating ring; 231, Needle mountain, 232, Needle mountain cover; 233, Limit hook; 234, Through groove; 250, Annular gear ring; 251, Stop ring; 252, Counting gear; 253, Limit lump; 254, Toggle switch; 255, Clamping block; 256, Arc-shaped clamping position; 260, Hand crank; 270, Accelerating gear set; 280, Transmission gear; 290, Tooth groove; 300, Yarn feeding device; 310, Yarn feeding port; 320, Yarn rack; 321, Threading hole; 322, Section groove; 421, Chuck; 500, Loop counting device; 600, Support foot.

DESCRIPTION OF EMBODIMENTS

In the following, the technical scheme in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by ordinary technicians in this field without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

As shown in FIGS. 1 to 9, a novel wool knitting machine provided by the present invention comprises a shell 100, a knitting device 200, a yarn feeding device 300 and a clamping device 400;

a middle part of the shell 100 is provided with a hollow annular groove 110 for installing the knitting device 200;

the knitting device 200 comprises a crochet needle cylinder 210 rotatably arranged in the annular groove 110, a plurality of crochet needles 220 distributed annularly, a wool separating ring 230 installed at an upper part of the crochet needles 220, and a driving mechanism installed at one side of the shell 100; the driving mechanism drives the crochet needle cylinder 210 to rotate, so as to make the crochet needles 220 do knitting movement up and down;

the yarn feeding device 300 comprises a yarn feeding port 310 arranged at one side of the shell 100, wherein the yarn feeding port 310 defines a yarn feeding channel for the wool to enter the knitting device 200, and further comprises a yarn rack 320 installed at a lower end of the yarn feeding port 310; the yarn rack 320 is provided with at least one threading hole 321 and a section groove 322 (also referred to herein as a sectioning groove) communicated with the threading hole 321;

the clamping device 400 is arranged beside the yarn feeding port 310 and comprises a sensing module and a clamping module, wherein when the sensing module senses that the crochet needle 220 reaches the yarn feeding port 310, the sensing module controls the clamping module to clamp the crochet needle 220 to clamp the wool.

Figure 3:
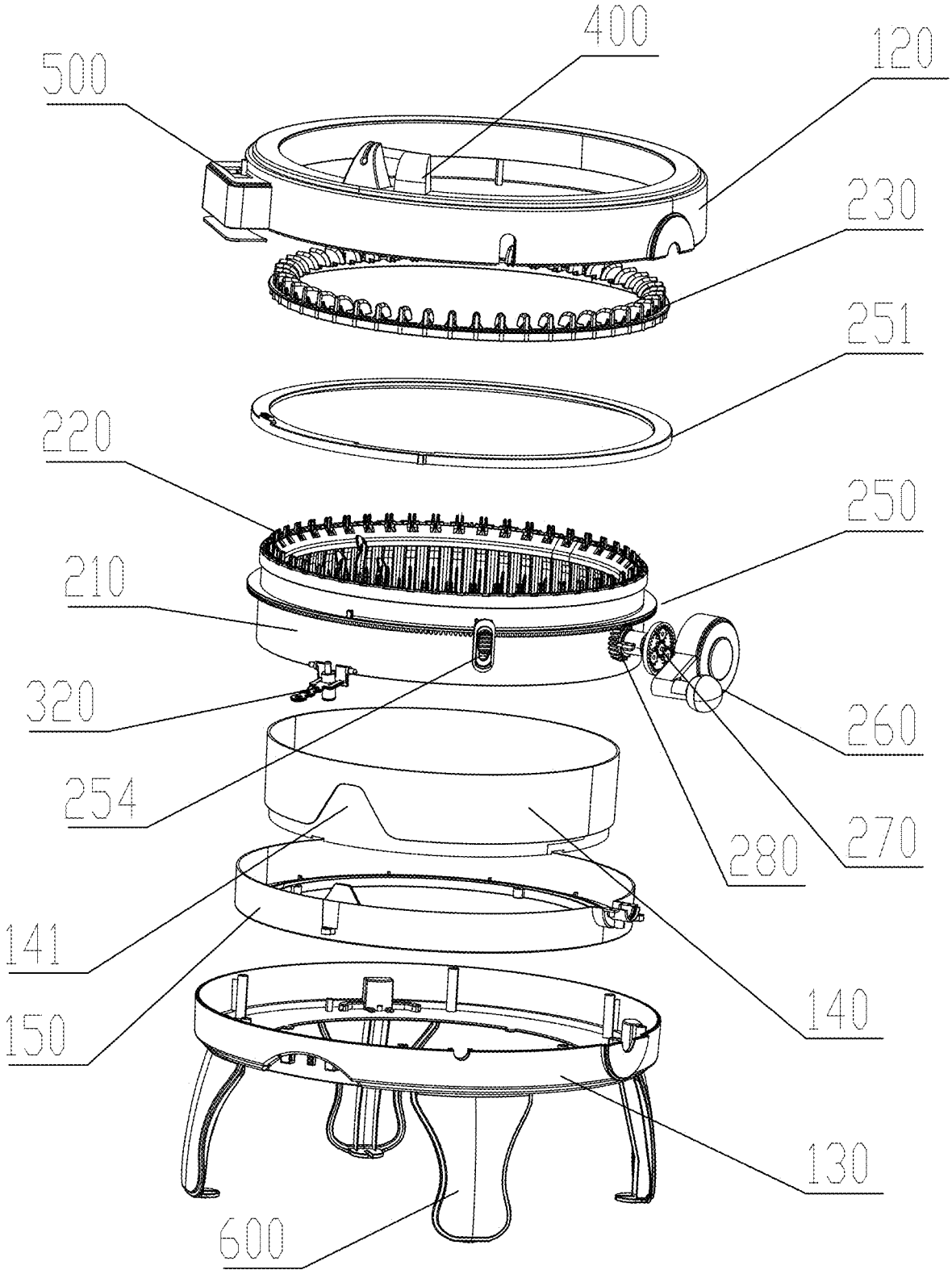
FIG. 3 is an explosion schematic diagram of the present invention.
Figure 4:
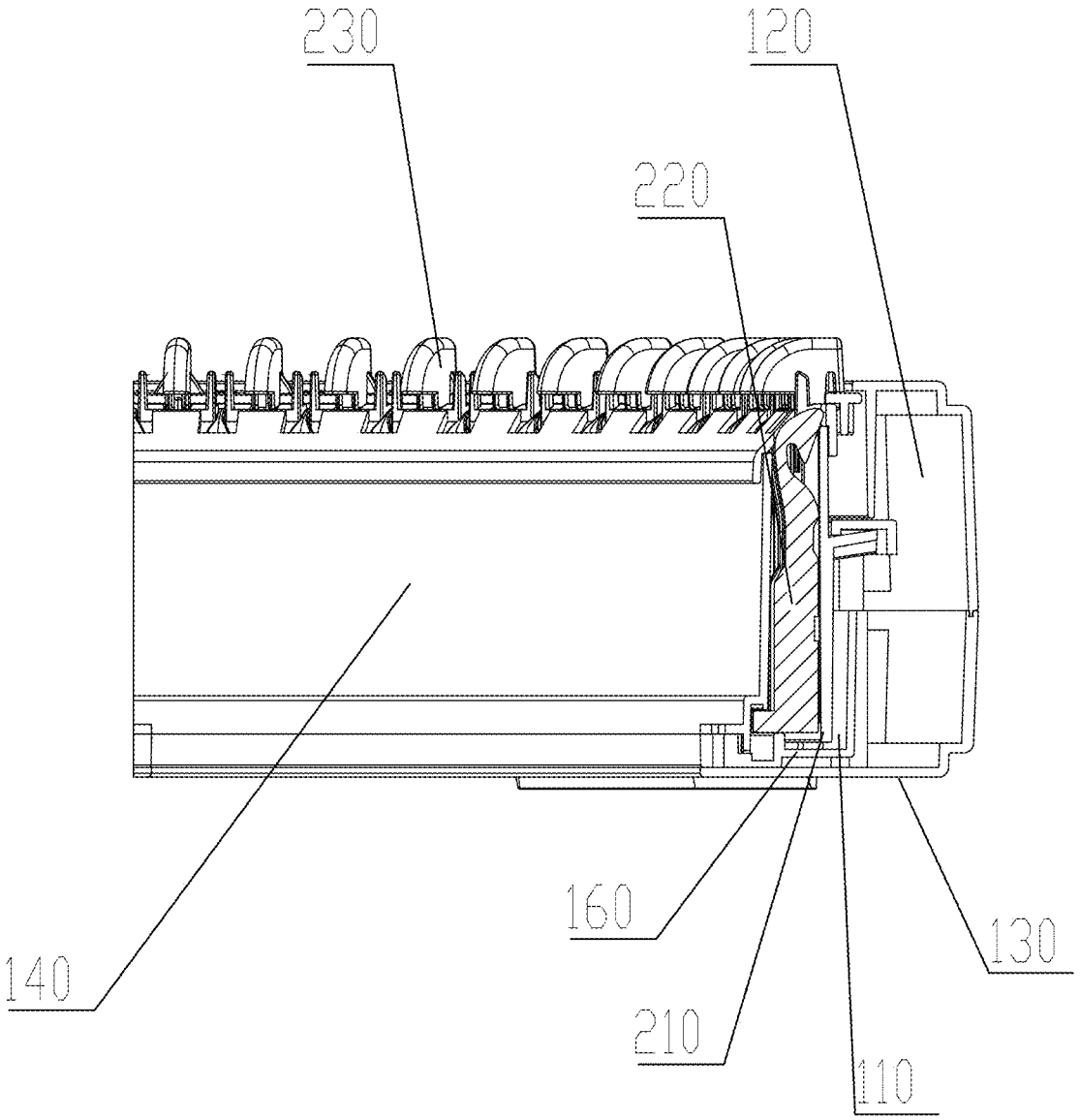
FIG. 4 is a schematic sectional view of a part of FIG. 1.

As a preferred embodiment of the present invention, as shown in FIGS. 3 and 4, the shell 100 includes a face cover 120, a bottom cover 130, an inner ring cover 140 and a needle cylinder base 150. The face cover 120, the bottom cover 130 and the inner ring cover 140 form an annular groove 110 with a hollow structure, and the needle cylinder base 150 is arranged at the upper part of the bottom cover 130, wherein the wool separating ring 230 is located between the face cover 120 and the inner ring cover 140; the contact surfaces of the face cover 120, the bottom cover 130 and the inner ring cover 140 are provided with connecting lugs for mounting screws, which are connected and fixed by screws.

Figure 6:
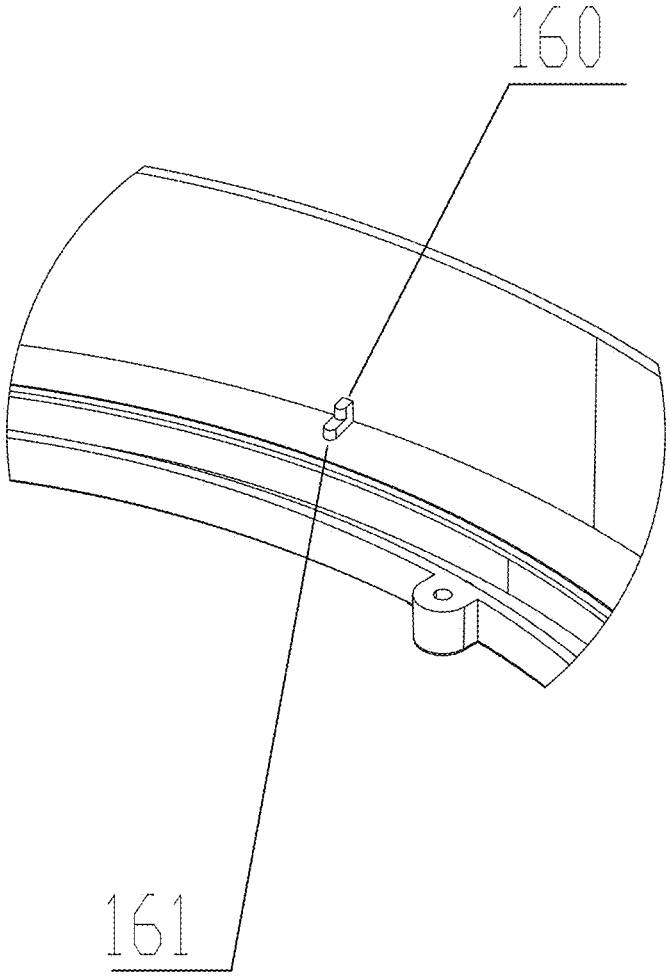
FIG. 6 is a partial enlarged view at b in FIG. 5.

As shown in FIG. 4 and FIG. 6, the upper part of the needle cylinder base 150 is provided with a plurality of guide blocks 160, and the guide blocks 160 are provided with notch grooves 161, and the bottom of the crochet needle cylinder 210 is in contact with the notch grooves 161, so that the friction force is reduced, the operation is easy, the efficiency is high, and the knitting speed is easier to master, wherein the side of the notch groove 161 has an arc-shaped structure, and the arc-shaped structure is attached to the outer surface of the crochet needle cylinder 210, so that the contact surface of the side is reduced, the friction force is reduced, and the rotation is smoother.

Figure 5:
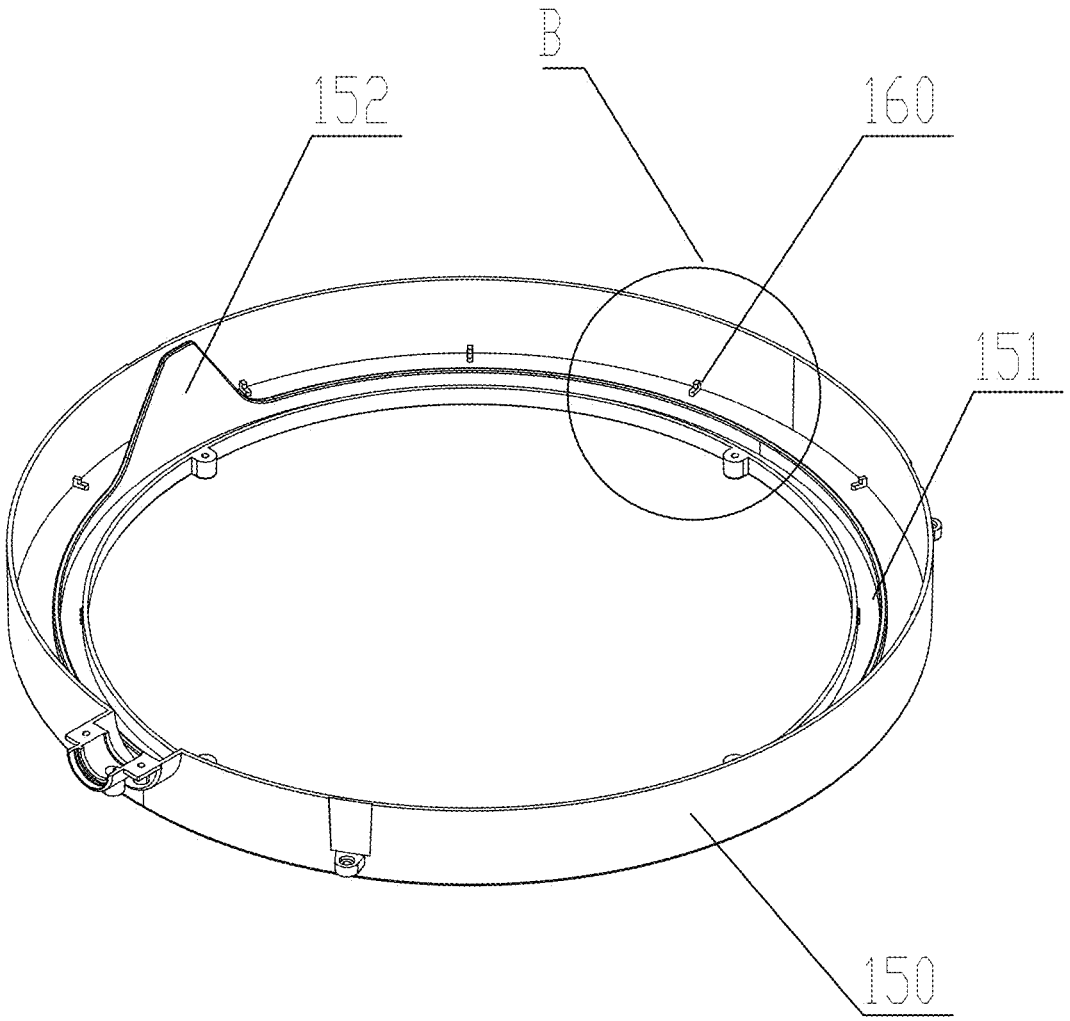
FIG. 5 is a schematic structural view of the needle cylinder base in FIG. 3.

As shown in FIGS. 3 and 5, the inner ring side of the needle cylinder base 150 is provided with a side cover groove 151, and the inner ring cover 140 is inserted into the side cover groove 151 and fixedly connected by screws. The needle cylinder base 150 is also provided with a convex position 152 for pushing the crochet needle 220 to rise, and both sides of the convex position 152 are inclined guide surfaces. When the crochet needle cylinder 210 rotates, the crochet needle 220 moves up and down when passing through the convex position 142. The lower side of the inner ring cover 140 has a corresponding convex surface 141, and a guide track is formed between the convex surface 141 and the needle cylinder base 150, and the bottom of the crochet needle 220 has a guide bend clamped in the guide track.

Figure 8:
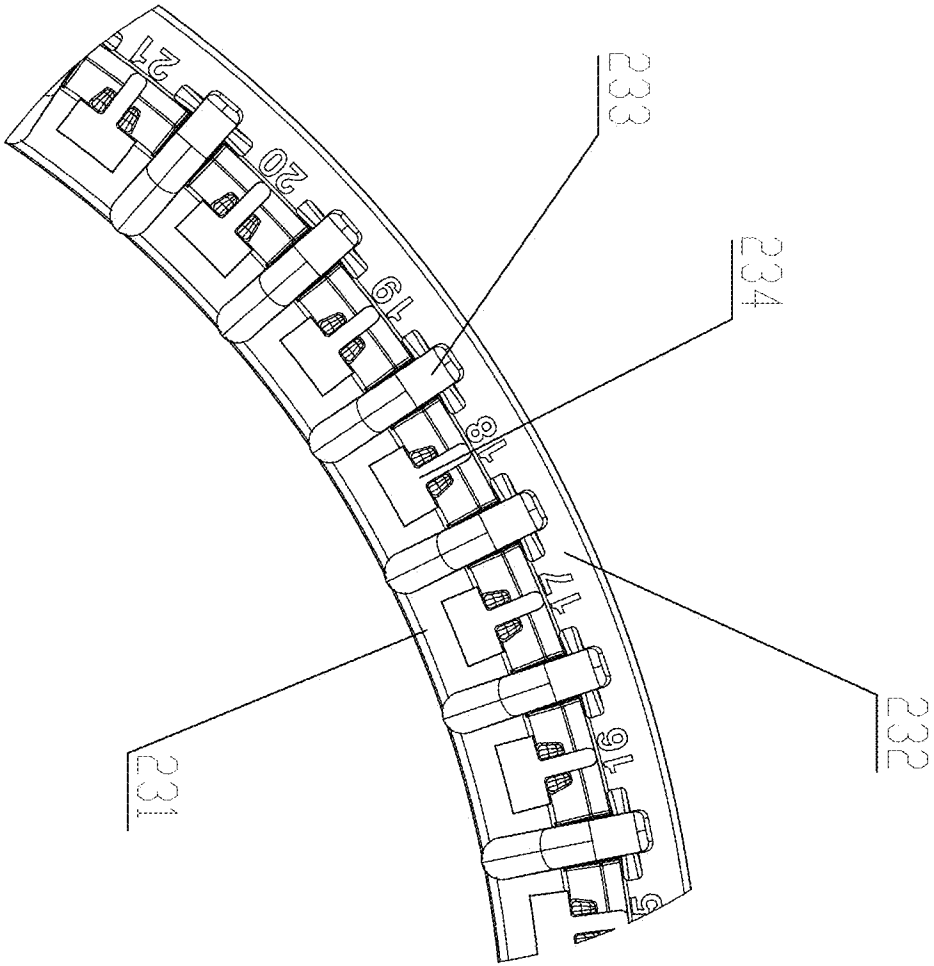
FIG. 8 is a schematic diagram of the partial structure of the wool separating ring.

As shown in FIG. 8, the wool separating ring 230 includes a needle hill 231 and a needle hill cover 232, both of which are fixedly connected with the crochet needle cylinder 210. The needle hill 231 is provided with a through groove 234 corresponding to the crochet needle 220, and the inner ring side of the needle hill cover 232 is provided with a plurality of limit hooks 233, which are staggered with the through grooves 234, and the needle hill cover 232 is also provided with a number label corresponding to the through groove.

Figure 7:
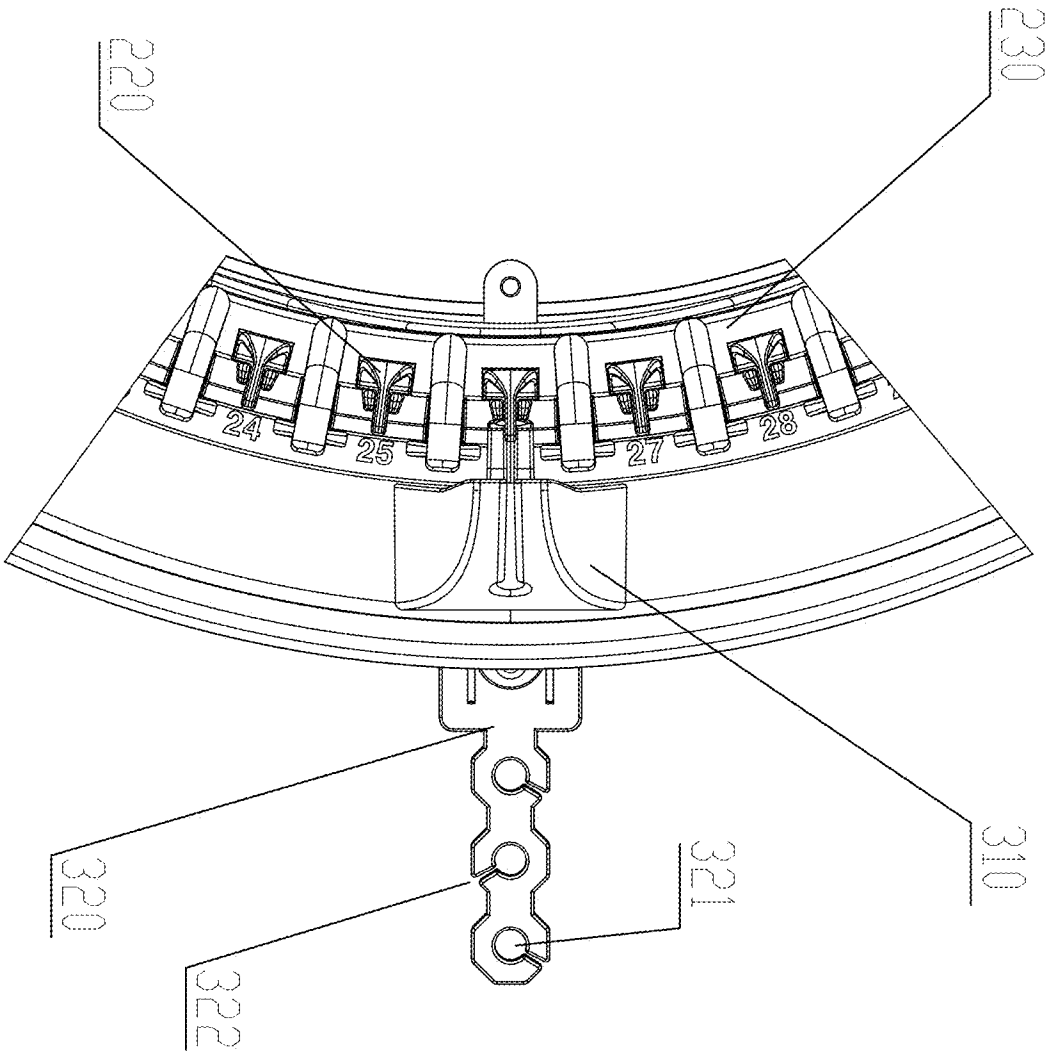
FIG. 7 is a schematic structural diagram of the yarn feeder.

As shown in FIG. 7, the device also includes a yarn rack 320 installed at the lower end of the yarn feeding port 310. The yarn rack 320 is provided with at least one threading hole 321 and section groove 322 communicating with the threading hole 321. The section groove 322 between adjacent threading hole 321 are located at different sides. In this embodiment, the number of threading hole 321 is three and the diameters are different from each other. Wool penetrates into the threading hole 321 through the section grooves 322 and passes through the threading hole 321. The tightness of the wool is adjusted by the threading hole 321. In some embodiments, more threading hole 321 can be set to give users more choices.

In this embodiment, as shown in FIG. 1, a plurality of support feet 600 are further arranged below the bottom cover 130, and the support feet 600 are detachably connected with the bottom cover 130 to effectively support the device provided by the present invention. In some embodiments, the support feet 600 can also be integrally formed with the bottom cover 130.

Figure 9:
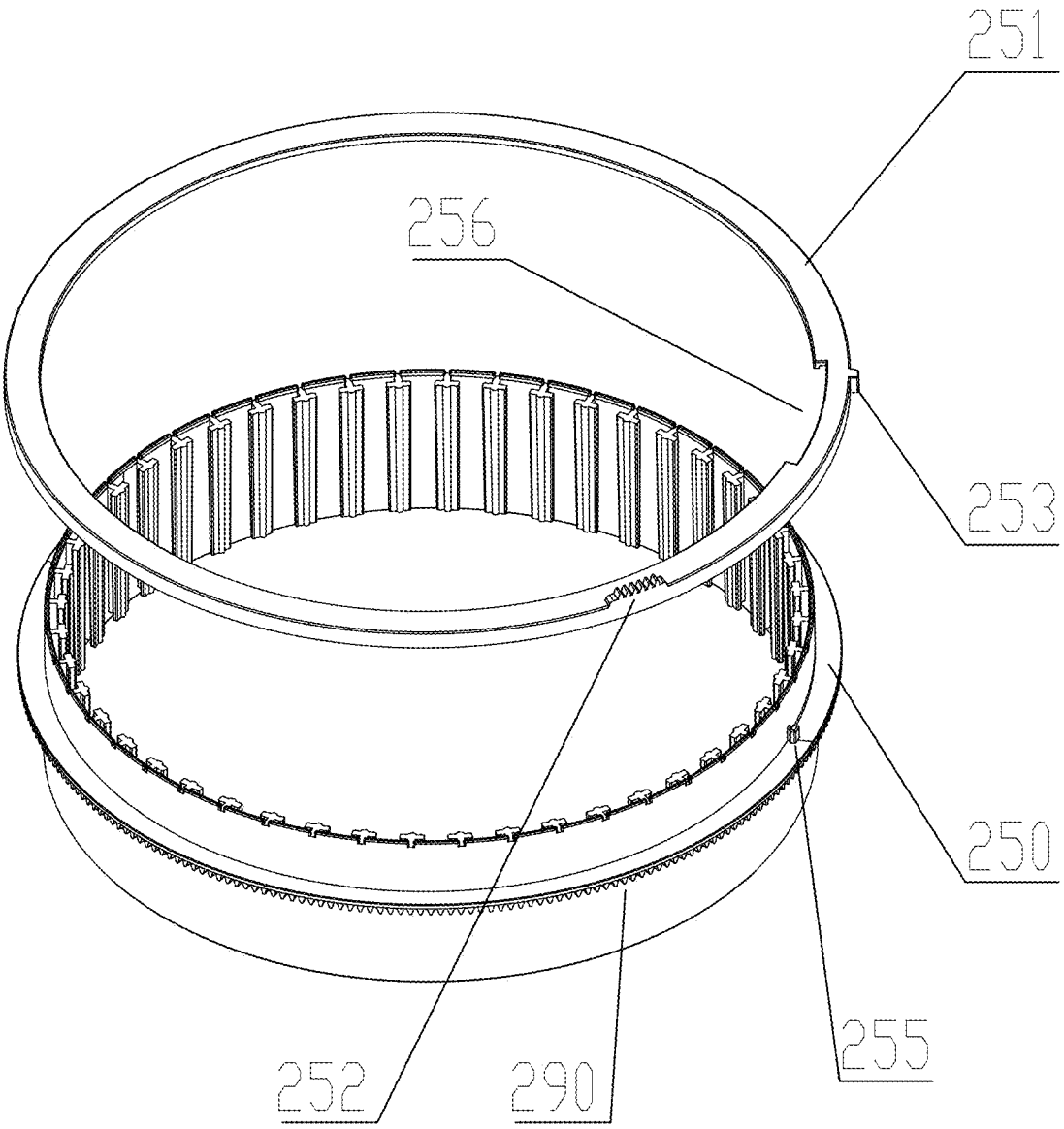
FIG. 9 structural schematic diagram of stop ring and annular gear ring.

As a preferred embodiment of the present invention, as shown in FIGS. 3 and 9, the driving mechanism consists of an annular gear ring 250 installed at the side edge of the crochet needle cylinder 210 and a hand crank 260 for driving the annular gear ring 250 to rotate, and the inner end of the hand crank 260 is provided with a transmission gear 280 meshing with the annular gear ring 250.

In this embodiment, as shown in FIG. 9, the bottom surface of the annular gear ring 250 is a tooth groove 290, the inner side of the annular gear ring 250 is inclined downward, the upper part of the annular gear ring 250 is provided with a stop ring 251, the bottom of the stop ring 251 has a U-shaped frame structure, the stop ring 251 moves with the annular gear ring 250, and the stop ring 251 is provided with a counting gear 252; the counting gear 252 is in transmission engagement with a loop counting device 500 installed on one side of the shell 100, and the loop counting device 500 displays the number of loops rotated by the knitting device 200, providing reference for users' knitting work.

The side edge of the stop ring 251 is provided with a limit bump 253, and the inner edge of the shell 100 is provided with a texture switching toggle switch 254, which can be locked or unlocked by up-and-down toggle operation, wherein the upper part of the annular gear ring 250 is provided with a clamping block 255, and the stop ring 251 is provided with an arc-shaped clamping position 256 corresponding to the clamping block 255.

In order to make the knitting process faster and reduce the physical strength of users, as a preferred embodiment of the present invention, as shown in FIG. 3, there is also an acceleration gear set 270 in the hand crank 260. By the acceleration gear set 270, the rotation speed of the transmission gear 280 meshed with the annular gear ring 250 is increased, so that when the user rotates the hand crank 260 once, the rotation speed of the annular gear ring 250 is faster, and the knitting speed of the knitting device 200 is also faster, which correspondingly saves the user greatly. In this embodiment, the accelerating gear set 270 is preferably configured as a planetary gear, and in some embodiments, it can also be other forms of accelerating gears.

In other embodiments, in order to facilitate the user's knitting operation, a switching device (not shown in the figure) is also arranged in the hand crank 260, and the user can switch whether to use the accelerating gear set 270 through this switching device to obtain different rotation speed choices. In some embodiments, in order to further save the user's physical strength and realize the automation of the knitting device 200, a motor can also be arranged in the handle crank 260, and the motor drives the rotation of the crochet needle cylinder 210 to realize the automatic knitting of the knitting device 200. In other embodiments, the driving mechanism includes a hand crank 260 and a motor, that is, manual and electric driving modes, which can be selected by the user according to actual use requirements.

Figure 2:
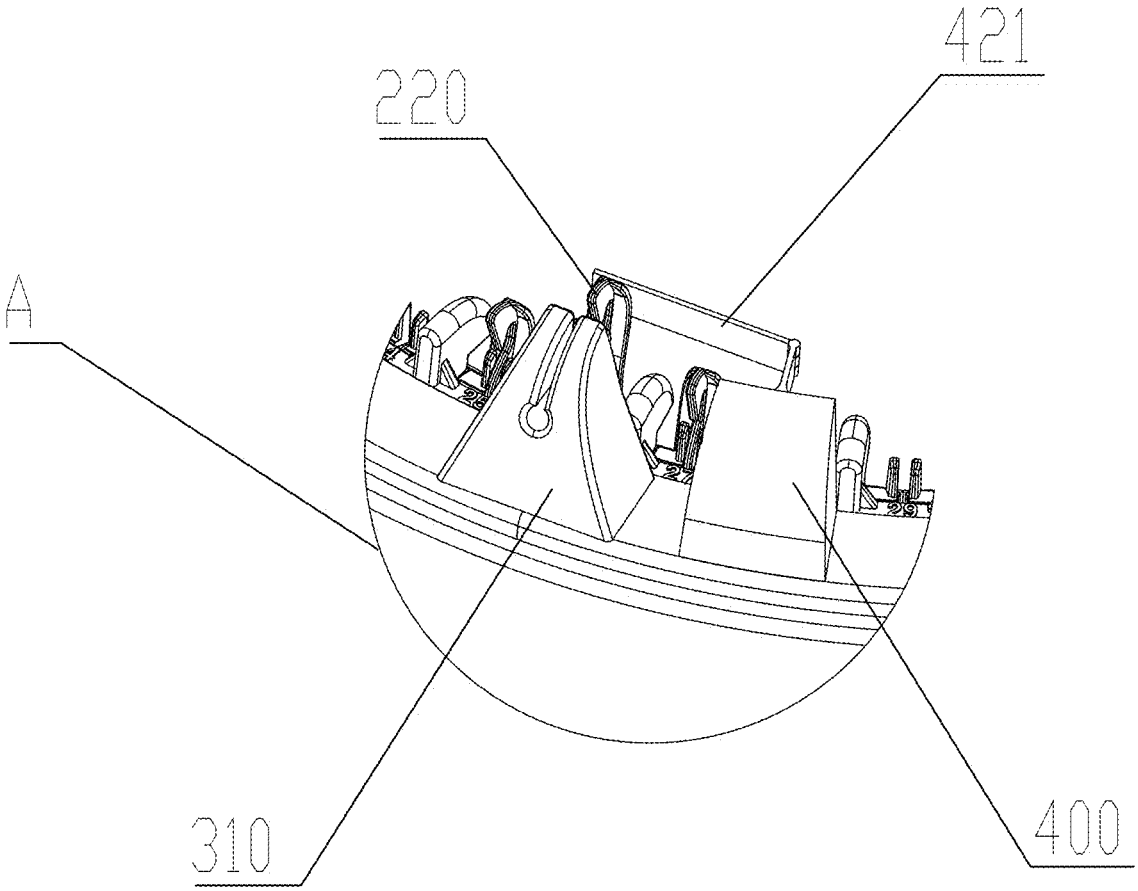
FIG. 2 is a partial enlarged view at a in FIG. 1.

In order to ensure that the knitting machine can make the first loop of knitting operation of the fabric compact enough without relying on the user to manually hold the wool during the first loop of knitting operation, as shown in FIG. 2, the present invention also provides a clamping device 400, which is arranged next to the yarn feeding port 310 and comprises a sensing module and a clamping module. When the sensing module senses that the crochet needle 220 reaches the yarn feeding port 310, the sensing module controls the clamping module to clamp the crochet needle 220 so as to clamp the wool.

In this embodiment, the sensing module includes a sensing probe, a control circuit board and a power supply, and the clamping module includes a chuck 421. The sensing probe, the chuck 421 and the power supply are electrically connected with the control circuit board. When the sensing probe senses that the crochet needle 220 moves to the yarn feeding port 310, the control circuit board controls the chuck 421 to clamp the crochet needle 220 to clamp the wool.

In this embodiment, the sensing probe is preferably configured as an infrared sensing probe, which senses whether the crochet needle 220 moves to the preset clamping position by using the infrared reflection principle, and then controls the chuck 421 to clamp the wool through the control circuit board, wherein the shape of the chuck 421 is configured to fit the outer contour shape of the crochet needle 220, so that the wool is not easy to fall off the crochet needle 220. In some embodiments, the sensing probe can also have other configurations, such as pressure sensor, vision sensor, displacement sensor, grating sensor, etc., to obtain the position information of the crochet needle 220, which the user can choose according to the actual use requirements.

The power supply is preferably configured as a lithium battery power supply, and is provided with a charging port, which can effectively improve the battery life of the sensing module. The clamping device 400 is also provided with a touch screen switch to turn on and off the clamping function. In some embodiments, the power supply can also be set as a dry battery or other forms of power supply, and the touch screen switch can also be set as a button.

By arranging the clamping device 400, when each crochet needle 220 reaches the position of the yarn inlet of the yarn feeding port 310, the chuck 421 is clamped with the current crochet needle 220, so as to clamp the wool, so that the first lap of the knitting operation is compact enough, and the knitting quality is guaranteed; and meanwhile, the accelerating gear set 270 is added in the hand crank 260, so that the knitting speed is further increased, and the knitting efficiency is improved, and the user does not need to consume a lot of physical strength when driving by hand.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A novel wool knitting machine, comprising a shell, a knitting device, a yarn feeding device and a clamping device, wherein:

a middle part of the shell is provided with a hollow annular groove for installing the knitting device;

the knitting device comprises a crochet needle cylinder rotatably arranged in the hollow annular groove, a plurality of crochet needles distributed annularly, a wool separating ring installed at an upper part of the crochet needles, and a driving mechanism installed at one side of the shell; the driving mechanism drives the crochet needle cylinder to rotate, so as to make the crochet needles do knitting movement up and down;

the yarn feeding device comprises a yarn feeding port arranged at one side of the shell, wherein the yarn feeding port defines a yarn feeding channel for a wool to enter the knitting device, and the yarn feeding device further comprises a yarn rack installed at a lower end of the yarn feeding port; the yarn rack is provided with at least one threading hole and a sectioning groove communicating with a threading hole of the at least one threading hole;

each of the plurality of crochet needles is configured to hook the wool; and the clamping device is arranged beside the yarn feeding port and comprises a sensing module and a clamping module, wherein when the sensing module senses that a crochet needle of the plurality of crochet needles reaches the yarn feeding port, the sensing module controls the clamping module to clamp the crochet needle and clamp the wool.

2. The novel wool knitting machine according to claim 1, wherein the shell comprises a face cover, a bottom cover, an inner cover and a needle cylinder base, wherein the inner cover is in the shape of a ring, wherein the face cover, the bottom cover and the inner cover form the hollow annular groove, and the needle cylinder base is arranged at an upper part of the bottom cover.

3. The novel wool knitting machine according to claim 2, wherein an upper part of the needle cylinder base is provided with a plurality of guide blocks, and the guide blocks are provided with notch grooves; a bottom of the crochet needle cylinder is in contact with the notch grooves, and a lateral part of each of the notch grooves has an arc-shaped structure, and is attached to an outer side surface of the crochet needle cylinder through the arc-shaped structure.

4. The novel wool knitting machine according to claim 3, wherein the wool separating ring comprises a needle hill and a needle hill cover, both of which are fixedly connected with the crochet needle cylinder; the needle hill is provided with a plurality of through grooves corresponding to the plurality of crochet needles, and an inner side of the needle hill cover is provided with a plurality of limit hooks, and the limit hooks are staggered with the plurality of through grooves.

5. The novel wool knitting machine according to claim 4, wherein the driving mechanism consists of an annular gear ring installed at a side edge of the crochet needle cylinder and a hand crank for driving the annular gear ring to rotate, and an inner end of the hand crank is provided with a transmission gear meshed with the annular gear ring.

6. The novel wool knitting machine according to claim 5, wherein a bottom surface of the annular gear ring comprises a tooth groove, an inner side of the annular gear ring is inclined downwards, an upper part of the annular gear ring is provided with a stop ring, and a bottom of the stop ring is a U-shaped frame; the stop ring is configured to moves along with the annular gear ring, and the stop ring is provided with a counting gear in driving engagement with a loop counting device installed at one side of the shell.

7. The novel wool knitting machine according to claim 6, wherein a lateral edge of the stop ring is provided with a limit bump, and an inner edge of the shell is provided with a toggle switch for changing knitting methods; the toggle switch is locked or unlocked with the limit bump through up-and-down toggle operation.

8. The novel wool knitting machine according to claim 7, wherein an accelerating gear set is arranged in the hand crank for increasing a hand knitting speed.

9. The novel wool knitting machine according to claim 8, wherein the sensing module comprises a sensing probe, a control circuit board and a power supply, and the clamping module comprises a chuck.

10. The novel wool knitting machine according to claim 9, wherein the sensing probe, the chuck and the power supply are electrically connected with the control circuit board, and when the sensing probe senses that the crochet needle of the plurality of crochet needles reaches the yarn feeding port, the control circuit board controls the chuck to clamp the crochet needle and clamp the wool.

11. A novel wool knitting machine, comprising a shell, a knitting device, a yarn feeding device, and a clamping device, wherein:

a middle part of the shell is provided with a hollow annular groove for installing the knitting device;

the knitting device comprises a crochet needle cylinder rotatably arranged in the hollow annular groove, a plurality of crochet needles distributed annularly, a wool separating ring installed at an upper part of the crochet needles, and a driving mechanism installed at one side of the shell; the driving mechanism is configured to drive the crochet needle cylinder to rotate, so as to make the crochet needles do knitting movement up and down;

the yarn feeding device comprises a yarn feeding port arranged at one side of the shell, wherein the yarn feeding port defines a yarn feeding channel for a wool to enter the knitting device, and the yarn feeding device further comprises a yarn rack installed at a lower end of the yarn feeding port; the yarn rack is provided with at least one threading hole and a sectioning groove communicating with a threading hole of the at least one threading hole;

each of the plurality of crochet needles is configured to hook the wool; and the clamping device is arranged beside the yarn feeding port and comprises a sensing module and a clamp; and the sensing module is configured to sense that a crochet needle of the plurality of crochet needles reaches the yarn feeding port, and is further configured such that when the sensing module senses that a crochet needle of the plurality of crochet needles reaches the yarn feeding port, the sensing module controls the clamp to clamp the crochet needle and clamp the wool.

12. The novel wool knitting machine according to claim 11, wherein the shell comprises a face cover, a bottom cover, an inner cover and a needle cylinder base, wherein the inner cover is in the shape of a ring, wherein the face cover, the bottom cover and the inner cover form the hollow annular groove, and the needle cylinder base is arranged at an upper part of the bottom cover.

13. The novel wool knitting machine according to claim 12, wherein an upper part of the needle cylinder base is provided with a plurality of guide blocks, and the guide blocks are provided with notch grooves; a bottom of the crochet needle cylinder is in contact with the notch grooves, and a lateral part of each of the notch grooves has an arc-shaped structure, and is attached to an outer side surface of the crochet needle cylinder through the arc-shaped structure.

14. The novel wool knitting machine according to claim 13, wherein the wool separating ring comprises a needle hill and a needle hill cover, both of which are fixedly connected with the crochet needle cylinder; the needle hill is provided with a plurality of through grooves corresponding to the plurality of crochet needles, and an inner side of the needle hill cover is provided with a plurality of limit hooks, and the limit hooks are staggered with the plurality of through grooves.

15. The novel wool knitting machine according to claim 14, wherein the driving mechanism consists of an annular gear ring installed at a side edge of the crochet needle cylinder and a hand crank for driving the annular gear ring to rotate, and an inner end of the hand crank is provided with a transmission gear meshed with the annular gear ring.

16. The novel wool knitting machine according to claim 15, wherein a bottom surface of the annular gear ring comprises a tooth groove, an inner side of the annular gear ring is inclined downwards, an upper part of the annular gear ring is provided with a stop ring, and a bottom of the stop ring is a U-shaped frame; the stop ring is configured to move along with the annular gear ring, and the stop ring is provided with a counting gear in driving engagement with a loop counting device installed at one side of the shell.

17. The novel wool knitting machine according to claim 16, wherein a lateral edge of the stop ring is provided with a limit bump, and an inner edge of the shell is provided with a toggle switch for changing knitting methods; the toggle switch is locked or unlocked with the limit bump through up-and-down toggle operation.

18. The novel wool knitting machine according to claim 17, wherein an accelerating gear set is arranged in the hand crank for increasing a hand knitting speed.

19. The novel wool knitting machine according to claim 18, wherein the sensing module comprises a sensing probe, a control circuit board and a power supply, and the clamp comprises a chuck.

20. The novel wool knitting machine according to claim 19, wherein the sensing probe, the chuck and the power supply are electrically connected with the control circuit board, and the knitting machine is configured such that when the sensing probe senses that the crochet needle of the plurality of crochet needles reaches the yarn feeding port, the control circuit board controls the chuck to clamp the crochet needle and clamp the wool.

* * * * *